United States Patent [19]

Wilkens

[11] 4,449,380

[45] May 22, 1984

[54] WARP KNITTED FABRIC AND PROCESS FOR ITS PRODUCTION

[75] Inventor: Christian Wilkens, Heusenstamm, Fed. Rep. of Germany

[73] Assignee: Karl Mayer Textilmaschinenfabrik GmbH, Obertshausen, Fed. Rep. of Germany

[21] Appl. No.: 348,796

[22] Filed: Feb. 16, 1982

[30] Foreign Application Priority Data

Feb. 28, 1981 [DE] Fed. Rep. of Germany ..... 3107816

[51] Int. Cl.[3] ..... D04B 23/06

[52] U.S. Cl. ..... 66/84 A; 66/207

[58] Field of Search ..... 66/190, 192, 195, 203, 66/84, 84 A, 207

[56] References Cited

U.S. PATENT DOCUMENTS 1,841,165 1/1932 Vorck et al. ..... 66/84

4,255,947 3/1981 Kohl ..... 66/84 A

*Primary Examiner*—Ronald Feldbaum

*Attorney, Agent, or Firm*—Omri M. Behr

[57] ABSTRACT

A warp knitting machine using warp and weft threads produces a fabric with a woven appearance on one side. The machine has at least one forward thread system for forming stitches and at least one rearward thread system for forming stitches. This rearward thread system is successively operable to reciprocally form a common stitch with a corresponding pair of the warp threads of the forward thread system. A weft thread magazine can repetitively place weft threads between the forward and rearward thread system. The forward thread system is successively operable to reciprocally lay a portion of each of its warp threads at one of two corresponding, alternate wales over at least one of the weft threads. The rearward thread system is operable to lay its warp threads behind the weft threads. Before making a stitch, the forward thread system performs at least one overlap of at least two needle spaces while the rearward thread system is displaced to reciprocally lay its warp thread about needles onto which adjacent warp threads of the forward thread system are laid.

13 Claims, 5 Drawing Figures

WARP KNITTED FABRIC AND PROCESS FOR ITS PRODUCTION

BACKGROUND OF THE INVENTION

1. Field of the Invention

The invention is directed to making a warp knitted fabric with methods and apparatus involving at least one forward and one rearward thread system which further comprises a plurality of inlayed weft threads. The fabric so produced has a woven appearance on one side.

2. Discussion of the Relevant Art

A warp knitting machine is known (U.S. Pat. No. 4,255,947) in which a weft thread is delivered by a weft thread magazine between a rearward guide bar and a set of three forward guide bars. The mode of operation is so arranged that the thread system of the forward guide bars form stitches while the threads of the rearward guide bars do not form stitches per se but are only knitted in by the stitches of the forward system.

In this way it is nevertheless possible to provide the appearance of woven fabric on the rearward side of the fabric. In this known arrangement, however, the weft and warp threads on the rear portion of the fabric are not visible in the same proportion as would be the case with typical woven fabrics. A typical woven characteristic is that the weft threads are partially overlayed and partially underlayed by the warp threads. Thus, a true woven appearance is not observed.

The purpose of the invention is to provide a warp knitted fabric of the aforementioned type which on one side thereof has the appearance of typical woven goods.

SUMMARY OF THE INVENTION

A warp knitting machine according to the principles of the present invention uses warp and weft threads. The machine has at least one forward thread system for forming stitches and at least one rearward thread system for forming stitches. The rearward thread system is successively operable to reciprocally form a common stitch with a corresponding pair of the warp threads of the forward thread system. Also included is a weft thread laying means for repetitively placing the weft threads between the forward and rearward thread system. The forward thread system is successively operable to reciprocally lay a portion of each of its warp threads at one of two, corresponding, alternate wales over at least one of the weft threads. The rearward thread system is operable to lay its warp threads behind the weft threads.

According to a related method of the same invention, knitted fabrics are formed with a warp knitting machine having a needle bar, at least a forward and rearward thread guide bar and a weft insertion magazine for inserting weft threads between the guide bars. The method includes the step of bringing the forward and rearward thread guide bars into a stitch building position. Another step is performing with the forward guide bar at least one overlap of a least two needle spaces while the rearward guide bar is displaced to reciprocally lay its warp thread about needles of the bar onto which adjacent warp threads of the forward guide bar are laid. The method also includes the step of performing a stitch with said needle bar.

By employing apparatus and methods of the foregoing type, the threads of both thread systems can form stitches in a warp knitted fabric by using at least a forward thread system and a rearward thread system with weft threads provided therebetween. The threads of both thread systems form stitches and the threads of the forward thread system overlay the weft threads in groups comprising at least one weft thread. This overlaying preferably occurs at alternatingly displaced wales after at least one course. Otherwise, all the threads run simularly behind the weft threads. Both thread systems form common stitches so that there is provided a fabric with a woven appearance on the forward side.

Such a warp knitted fabric has on its forward side the appearance of typical woven fabrics. This impression is provided by having single warp threads running alternately above and below the weft threads. This impression is obtained in that the portions of the threads of the forward thread system which are visible above the weft threads are transversely displaced with subsequent weft thread groups. In the simplest case a thread of the forward system provides two adjacent warp threads of the woven pattern. The thus layed threads of the forward thread system so not provide a complete fabric despite stitch formation. The threads of the rearward thread system which similarly form stitches serve to fulfill this purpose in that together with the threads of the forward thread system they provide a complete fabric. In all of this, the woven appearance is achieved with minimal thread use since the forward and rearward systems together provide the complete fabric, thus both thread systems can contain a lower number of threads relative to the number of stitch wales, in fact about half is adequate.

In the preferred method of making this knitted fabric, the foward and rearward guide bars, prior to stitch formation, are brought into the underlapping position. Between successive stitch forming steps the forward guide bar performs an overlap of at least two needle spaces while the rearward guide bar is so far displaced that its threads are layed alternately with needles receiving threads of the forward guide bars.

BRIEF DESCRIPTION OF THE DRAWINGS

In order that the invention may be more fully understood, it will now be described, by way of example, with references of the accompanying drawings in which.

DESCRIPTION OF THE PREFERRED EMBODIMENTS

Figure 1:
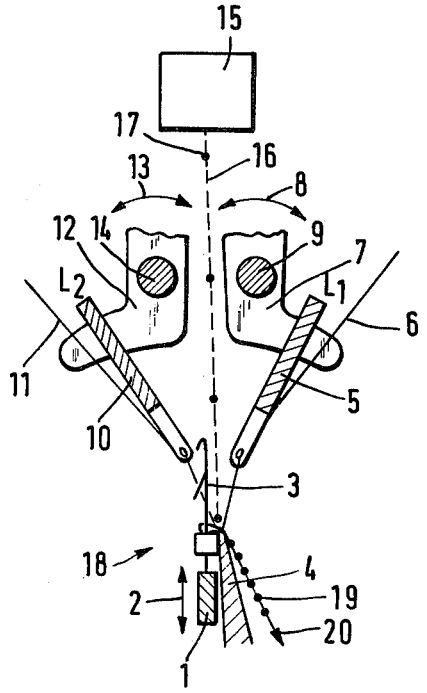
FIG. 1 is a simplified, side, elevational view of the working area of a knitting machine according to the principles of the present invention.

In the warp knitting machine illustrated in FIG. 1, a vertically reciprocatable needle bar 1 is provided which is moved up and down in a vertical plane by means of a schematically illustrated drive means 2. Bar 1 carries a plurality of regularly spaced latch needles 3 to form a needle bed. These needles 3 operate in conjunction with a reciprocating knockover sinker bar 4. A forward guide bar 5 terminates in a plurality of spaced, apertured thread guides. Thus guide bar 5 can control threads 6 of a forward thread system L1. Guide bar 5 is attached to rotatable lever 7 which is swingable about an axis 9 under the influence of a schematically illustrated drive 8 and which, furthermore, is also displaceable in the axial direction (i.e. in and out of the paper). The motion of bars 5 and 1 and sinker 4 are synchronized to perform threading in, lapping, stitching, knocking over and other usual knitting steps.

A rearward guide bar 10 is similarly synchronized to form a rearward thread system L2 and is attached to lever 12 which is similarly swingable about axis 14 under the influence of drive means 13 and can similarly be displaced in an axial direction. Again guide bar 10 terminates in a plurality of spaced, apertured thread guides which hold warp threads 11. A weft thread insertion magazine 15 of conventional construction carries weft inlay threads 17 via a chain transportation system 16 to working area 18. An example of such a chain transport can be found in U.S. Pat. No. 4,255,947. The finished fabric 19 is pulled off in the direction of arrow 20. In place of latch needles there may also be utilized slider needles and bearded needles.

It is particularly advantageous to utilize, in rearward thread system L2, thinner thread material as that utilized in forward thread system L1. In this manner the rearward thread system L2 is optically very unobtrusive or totally invisible. Also, the utilization of thread is very low and since the thinner material is light and cheap a corresponding reduction of cost may be achieved.

Figure 2:
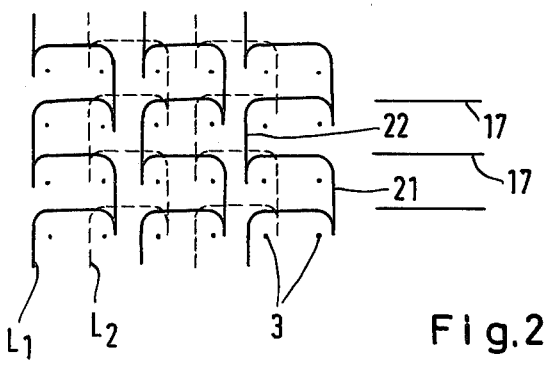
FIG. 2 is a lapping diagram of fabric produced in accordance with the present invention.

FIG. 2 is a lapping diagram for goods produced in accordance with the present invention. Both the forward thread system L1 as well as the rearward thread system L2 (the latter indicated in phantom) simultaneously move to the right and in the next working cycle to the left to provide an overlap of two needles 3. Weft threads 17 are indicated on the side. Thus, a common stitch is provided on all needles by both thread systems L1 and L2.

In operation, thread systems L1 and L2 thread warp thread in an alternated fashion between each needle space. Contemporaneously, one of the weft threads is then inserted between thread systems L1 and L2. Thereafter, thread systems L1 and L2 shog laterally to the right by two needle spaces to overlp two needles. Each needle is overlapped by two warp threads from the two adjacent thread systems L1 and L2. The thread systems L1 and L2 then swing again backwards through the needles. Thereafter, a stitch cycle proceeds wherein the latch needles descend and form stitches which are knocked over. As the thread systems L1 and L2 now swing forward, thread segment 21 (and subsequently segment 22) of thread system L1 overlays weft threads 17. This cycle repeats except that on alternate cycles, thread systems L1 and L2 shog to the left. This alternate shogging ensures an interlocking stitch between adjacent threads of systems L1 and L2. It will be appreciated that the foregoing causes warp threads to overlay weft threads 17 by the vertical alternating segments 21 and 22 of the forward thread system. All other portions of the fabric are essentially to be found behind the weft threads 17.

Figure 3:
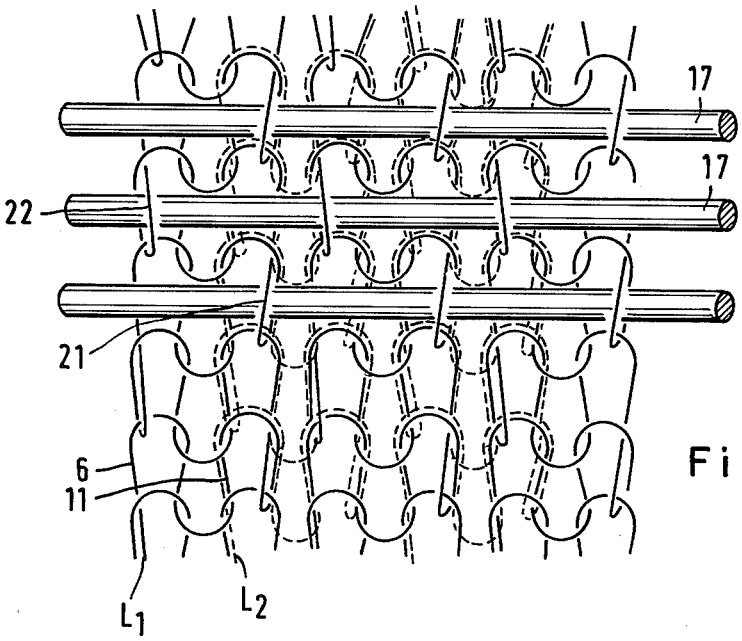
FIG. 3 is a plan view of a stitch pattern of fabric produced with the lapping diagram of FIG. 2.

The resulting fabric is clearly illustrated in FIG. 3 showing the completed stitches of the finished fabric of FIG. 2. Warp threads 6 of forward system L1 are shown in full while warp threads 11 of rearward system L2 are again shown in phantom. All segments 21 of forward thread 6 give the appearance of a single straight warp thread. Segments 22 of the same forward thread 6 appear as another adjacent warp thread. Thus an apparent woven pattern is formed on the right side of the fabric of the weft threads 17 and the aforementioned warp thread segments 21 and 22. In this procedure both thread systems L1 and L2 have formed interlocking stitches. Since the forward guide bar performs an overlap of at least two needles, the subsequent segments of thread of the forward thread system L1 which overlay the weft threads are sidewardly displaced in relationship to each other. The rearward guide bar is operated so that a unitary fabric is formed by the forward and rearward threads. Threads 6 and 11 of both thread systems form common stitches. The threads 6 of the forward thread system overlay the weft threads in groups of at least one weft thread with an alternating displacement of at least one stitch. Otherwise, threads 6 run similary to the threads 11 of the rearward thread system, behind the weft threads.

While the foregoing uses the simple lapping pattern of FIG. 2, by utilizing the same methodology, however, it is possible to achieve other weave-like patterns. For example, two weft threads may be overlayed by a simple, straight warp thread segment which then underlies the following two weft threads. It is also possible by utilizing the rearward warp threads when they are layed around each needle, to provide a continuous fabric and to work on the forward side with the forward warp threads in such a manner as to provide a pattern so that a stitch is not formed in each working cycle. With overlaps of more than two needles other variations may be provided.

Figure 4:
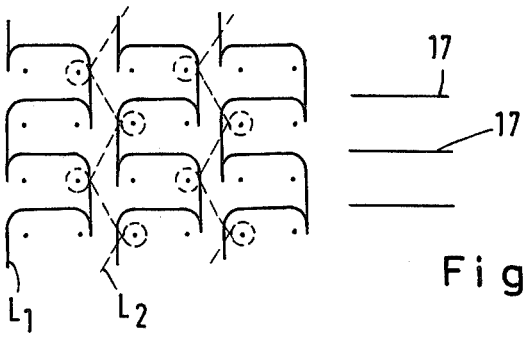
FIG. 4 is an alternate lapping diagram according to another embodiment of the present invention.

FIG. 4 shows by a lapping diagram, a further embodiment of the invention wherein the forward thread system L1 provides only an overlap of two needles 3 as previously. On the other hand the rearward thread system L2 moves in a manner similar to the well-known tricot stitch. In this arrangement only every second needle is overlapped by a common stitch from both thread systems; whereas on each of the intermediate needles a stitch is only formed by the forward thread system L1. Accordingly the rearward system L2 overlaps in the same direction as the forward but only to the extent of one needle space before swinging backwards through needles 3 and allowing another stitch to form. Thereafter only the rearward thread system L2 underlaps, reversing direction and advancing one needle space before swinging forward through needles 3, meeting forward thread system L1 to commence another cycle.

Again a continuous fabric is formed, with the warp thread of system L1 periodically overlaying weft threads 17 at alternating wales to produce a woven appearance similar to that described earlier.

In FIG. 2 as well as in FIG. 4 both the threads of the forward and the threads of the rearward thread system are threaded into guide bar 5 and 10 with double needle spacing. Thus, by themselves they do not provide a connected stitch system. Nevertheless, together they are so interstitched that continuous fabric is produced. While in FIG. 2 the threads of the rearward thread system are respectively threaded between the threads of the forward thread system, in FIG. 4 the threads of the rearward thread system can be threaded in at the same position as the threads of the forward thread system.

Figure 5:
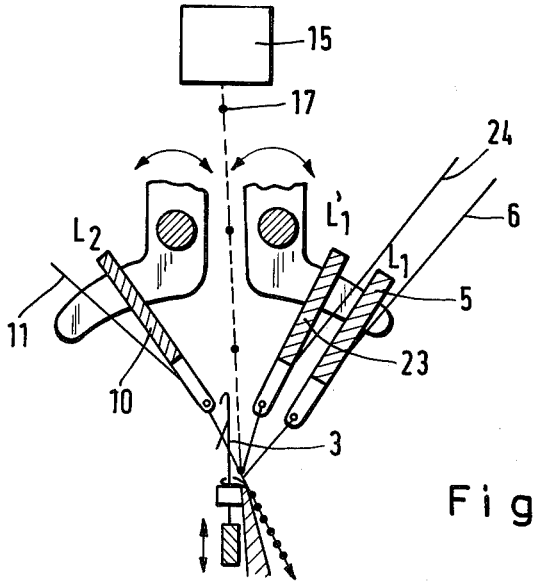
FIG. 5 is a simplified, side, elevational view of a warp knitting machine utilized to produce fabric in accordance with the present invention, which is an alternate to that of FIG. 1.

In the embodiment illustrated in FIG. 5, in contrast to that of FIG. 1, there is provided a further guide bar 23 for delivering threads 24 of a second forward thread system L1'. By using two forward thread systems, the patterning possibilities are substantially increased. The forward threads 24 can be worked in the same direction as the other forward threads 6 or in the converse direction. Both threads can be threaded in at the same position or displaced with respect to each other. It is also possible to provide a larger number of forward guide bars. Similarly, two or more rearward guide bars may also be provided. In either case, the additional guide bars can be separately mounted on independent levers so that each bar can shog or swing independently of the others.

When double forward guide bars are employed, threading in can be performed with two guides per needle space. Contemporaneously, the rearward guide bar forms an overlap of two needles alternately to the right and to the left. Again a single forward thread (or a contiguous pair of threads) can provide the appearance of two spaced warp threads in a weave patterning.

Similarly the threading in of the rear guide bars can be achieved with two guides per needle space, but between the threads of the forward guide bars. Again, the rearward guide bars perform an overlap of two needles alternately to the left and to the right. The resulting fabric also has a woven appearance.

Alternatively, the thread being threaded in from the rearward guide bars at the rate of two guides per needle space can be provided at the same position as the threads of the forward guide bars. In this situation the rearward guide bars can form a binding of the tricot type.

The examples illustrate a warp knitted fabric ware which has an appearance similar to a woven fabric such as canvas in which respectively one warp thread runs over and under adjacent weft threads while the adjacent warp thread runs in the opposite direction.

It will be understood that various changes in the detail, materials, arrangement of parts and operating conditions which has been herein described and illustrated in order to explain the nature of the invention may be made by those skilled in the art within the principles and scope of instant invention.

Having thus set forth the nature of the invention, what is claimed is:

1. A warp knitting machine using warp and weft threads, comprising:

a needle bed;

a least one forward thread system for forming stitches at said needle bed;

at least one rearward thread system for forming stitches at said needle bed, said rearward system being operable to move its warp thread into contact with said needle bed to enable said bed to grasp and pull into stitches the warp thread of said rearward thread system, said rearward thread system being successively operable to reciprocally form a common stitch with a corresponding pair of the warp threads of said forward thread system; and weft thread laying means for repetitively laying said weft threads over the full length of the needle bed placing said weft threads between said forward and said rearward thread system, said forward thread system being successively operable to reciprocally lay a portion of each of its warp threads at one of two corresponding, alternate wales over at least one of said weft threads, said rearward thread system being operable to lay its warp threads behind said weft threads.

2. A warp knitting machine according to claim 1 wherein the warp threads of said rearward thread system are thinner than those of the forward thread system.

3. A warp knitting machine according to claim 1 comprising:

a needle bed, said forward and said rearward thread system being periodically moveable into a stitch building position, said forward thread system being arranged to overlap said needle bed by two needle spaces in the time interval between two respective arrivals of said forward thread system at said stitch building position, said rearward system being arranged to be displaced to allow reciprocal laying of its warp thread about needles of said bed onto which adjacent warp threads of said forward thread system are laid.

4. A warp knitting machine according to claim 3 wherein said forward thread system is operable to overlap said needle bed by two needle spaces in a direction that periodically reverses.

5. A warp knitting machine according to claim 4 wherein said forward thread system comprises a plurality of thread guides, a pair for each needle space.

6. A warp knitting machine according to claim 5 wherein said rearward thread system comprises a plurality of thread guides, a pair for each needle space, said rearward thread system being operable to overlap said needle bed by two needle spaces in a direction that periodically reverses, said rearward thread system being operable to lay warp threads into said needle bed in needle spaces between those into which the warp thread is layed by said forward thread system.

7. A warp knitting machine according to claim 4 wherein said rearward thread system is operable to lay the warp thread into said needle bed in the same needle spaces as said forward thread system, said rearward thread system being operable to provide a tricot-type knot.

8. A warp knitting maching according to claim 7, wherein said rearward thread system comprises a plurality of thread guides, a pair for each needle space.

9. A method for forming knitted fabrics with a warp knitting machine having a needle bar, at least a forward and rearward thread guide bar and a weft insertion magazine for inserting weft threads betweein the guide bars, comprising the cyclically repeating steps of:

inserting weft threads between the forward and rearward guide bars toward said needle bed;

bringing said forward and rearward thread guide bars into a stitch building position;

performing with said forward guide bar at least one overlap of at least two needle spaces in a direction opposite to that of the prior cycle while said rearward guide bar is displaced to reciprocally lay its warp thread about cyclically alternating needles of said bar onto which cyclically alternating ones of an adjacent pair of warp threads of said forward guide bar are laid to interconnect said adjacent pair; and performing a stitch with said needle bar.

10. A method according to claim 9 wherein said overlap with said forward guide bar is performed over two needle spaces in a direction that periodically reverses.

11. A method according to claim 10 wherein said forward guide bar is threaded one in, one out.

12. A method according to claim 11 wherein the threading of said rearward guide bar is one in, one out, the method including the steps of:

threading in warp threads with said forward and rearward bars in an interleaved relation; and overlapping said neele bar with warp thread of said rearward bar by two needle spaces in a direction that periodically reverses.

13. A method according to claim 11 wherein the threading of the rearward guide bar is one in, one out, comprising the step of:

threading in warp threads with said rearward guide bar at the same needle spaces occupied by warp threads of said forward guide bar, said rearward guide bar providing a tricot-type knot.

* * * * *